US009500115B2

(12) United States Patent
Quix et al.

(10) Patent No.: US 9,500,115 B2
(45) Date of Patent: Nov. 22, 2016

(54) METHOD AND SYSTEM FOR AN INTERNAL COMBUSTION ENGINE WITH LIQUID-COOLED CYLINDER HEAD AND LIQUID-COOLED CYLINDER BLOCK

(71) Applicant: Ford Global Technologies, LLC, Dearborn, MI (US)

(72) Inventors: Hans Guenter Quix, Herzogenrath (DE); Sebastiaan Lambertus van den Heuvel, Wijnandsrade (NL); Wilbert Hemink, Landgraaf (NL); Jan Mehring, Cologne (DE); Anselm Hopf, Baesweiler (DE); Klaus-Peter Heinig, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 177 days.

(21) Appl. No.: 14/163,618

(22) Filed: Jan. 24, 2014

(65) Prior Publication Data

US 2014/0245975 A1 Sep. 4, 2014

(30) Foreign Application Priority Data

Mar. 1, 2013 (DE) ..... 10 2013 203 474

(51) Int. Cl.

| | |
|---|---|
| ***F01P 7/14*** | (2006.01) |
| ***F01P 7/16*** | (2006.01) |
| ***F01P 5/10*** | (2006.01) |
| ***F01P 3/02*** | (2006.01) |

(52) U.S. Cl.

CPC ..... *F01P 7/165* (2013.01); *F01P 3/02* (2013.01); *F01P 5/10* (2013.01); *F01P 2003/027* (2013.01); *F01P 2060/08* (2013.01)

(58) Field of Classification Search

CPC ..... F01P 2003/027; F01P 7/165; F01P 3/02; F01P 2003/028

USPC ..... 123/41.08

See application file for complete search history.

(56) References Cited

U.S. PATENT DOCUMENTS 4,369,738 A * 1/1983 Hirayama ..... F01P 7/165 123/41.1

4,423,705 A * 1/1984 Morita ..... F01P 5/12 123/41.02

(Continued)

OTHER PUBLICATIONS

Quix, Hans Guenter, "Liquid-Cooled Internal Combustion Engine with Liquid-Cooled Cylinder Head and with Liquid-Cooled Cylinder Block," U.S. Appl. No. 14/139,083, filed Dec. 23, 2013, 36 pages.

(Continued)

*Primary Examiner* — John Kwon
*Assistant Examiner* — James Kim
(74) *Attorney, Agent, or Firm* — Julia Voutyras; Alleman Hall McCoy Russell & Tuttle LLP

(57) ABSTRACT

Methods and systems are provided for separately providing liquid-cooling to a cylinder head and a cylinder block. In one example, a method includes selectively pumping coolant with a single pump to each of a first cylinder head coolant jacket and a cylinder block coolant jacket based on engine temperatures. The method further includes discharging coolant from the first cylinder head coolant jacket to a heating circuit line including a vehicle interior heater and discharging coolant from the cylinder block cooling jacket and back to the single pump.

17 Claims, 3 Drawing Sheets

(56) References Cited

U.S. PATENT DOCUMENTS

| | | | | |
|---|---|---|---|---|
| 6,874,450 | B2 * | 4/2005 | Hwang | F01P 3/02 123/41.28 |
| 7,237,513 | B2 * | 7/2007 | Pfeffinger | F01P 7/162 123/41.29 |
| 8,695,541 | B2 * | 4/2014 | Nishikawa | F01P 3/02 123/41.08 |
| 8,746,187 | B2 * | 6/2014 | Nogawa | F01P 3/02 123/41.82 R |
| 2003/0019442 | A1 * | 1/2003 | Yoshikawa | F01P 7/167 123/41.1 |
| 2009/0205590 | A1 * | 8/2009 | Vetrovec | F01P 11/20 123/41.14 |
| 2009/0304531 | A1 * | 12/2009 | Vanderwees | H01M 8/04029 417/279 |
| 2012/0103283 | A1 * | 5/2012 | Mehring | F01P 3/02 123/41.02 |
| 2013/0333642 | A1 * | 12/2013 | Kang | F01P 7/167 123/41.08 |

OTHER PUBLICATIONS

Steiner, Bernd et al., "Coolant Circuit with Head and Block Coolant Jackets Connected in Series," U.S. Appl. No. 14/148,621, filed Jan. 6, 2014, 24 pages.

* cited by examiner

METHOD AND SYSTEM FOR AN INTERNAL COMBUSTION ENGINE WITH LIQUID-COOLED CYLINDER HEAD AND LIQUID-COOLED CYLINDER BLOCK

CROSS REFERENCE TO RELATED APPLICATIONS

The present application claims priority to German Patent Application No. 102013203474.1, filed on Mar. 1, 2013, the entire contents of which are hereby incorporated by reference for all purposes.

BACKGROUND/SUMMARY

Engines may utilize various cooling jackets in the head and block to provide cooling. However, there may be competing objectives for the cooling system relating to increasing engine efficiency and waste heat rejection, improving engine warm-up, maintaining peak temperature control, providing cabin heating, etc.

One approach to balance such objectives includes an engine method, comprising: selectively pumping coolant with a single pump to each of a first cylinder head coolant jacket and a cylinder block coolant jacket based on engine temperatures, discharging coolant from the first cylinder head coolant jacket to a heating circuit line including a vehicle interior heater, and discharging coolant from the cylinder block cooling jacket and back to the single pump. For example, an engine cooling system may include a single pump coupled to both an inlet to the first cylinder head coolant jacket and an inlet to the cylinder block coolant jacket. A first shut-off element may be positioned between the pump and the cylinder block while a second shut-off element may be positioned between the pump and the cylinder head. Adjusting positions of the first and second shut-off elements may control a flow rate and/or flow percentage of coolant through each of the first cylinder head coolant jacket and the cylinder block coolant jacket. For example, during an engine cold-start, an engine warm-up phase may be initiated. During this phase, the first shut-off element may be closed to allow coolant to flow only through the first cylinder head coolant jacket of the cylinder head. This coolant then flows to the vehicle interior heater and back to the pump. Stopping coolant flow to the cylinder block may allow the engine to heat more quickly, thereby improving engine performance and reducing fuel consumption. Further, by flowing coolant through only the cylinder head and into the vehicle interior heater, the interior of the vehicle could be heated up at the same time, thereby increasing comfort of vehicle passengers.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
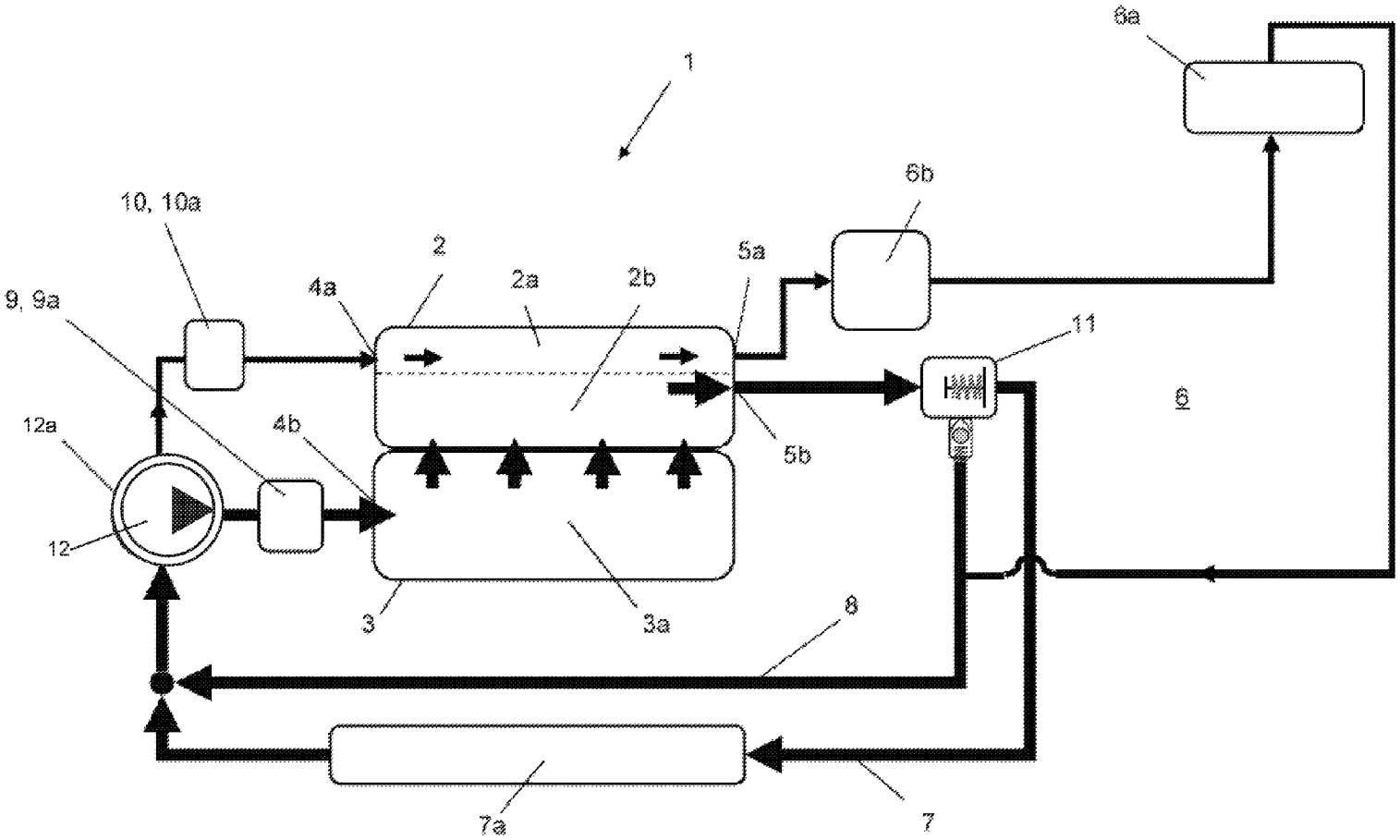
FIG. 1 is a schematic showing a first embodiment of an internal combustion engine with a single, common coolant pump.

The following description relates to an internal combustion engine having at least one liquid-cooled cylinder head and one liquid-cooled cylinder block, in which:

the at least one cylinder head is equipped with at least one integrated coolant jacket, said first coolant jacket having, at the inlet side, a first supply opening for the feed of coolant and, at the outlet side, a first discharge opening for the discharge of the coolant, the cylinder block is equipped with at least one integrated coolant jacket, said coolant jacket, which is associated with the block, having, at the inlet side, a second supply opening for the feed of coolant and, at the outlet side, a second discharge opening being provided for the discharge of the coolant, and, to form a coolant circuit, the discharge openings are at least connectable to the supply openings.

The invention also relates to a method for controlling the cooling arrangement of an internal combustion engine of said type. The method for controlling the cooling arrangement is described further below with reference to FIGS. 2A-2B.

An internal combustion engine of the above-stated type is used for example as a drive for a motor vehicle. Within the context of the present invention, the expression "internal combustion engine" encompasses diesel engines and Otto-cycle engines and also hybrid internal combustion engines, that is to say internal combustion engines which can be operated using a hybrid combustion process.

It is basically possible for the cooling arrangement of an internal combustion engine to take the form of an air-type cooling arrangement or a liquid-type cooling arrangement. On account of the higher heat capacity of liquids, it is possible for significantly greater quantities of heat to be dissipated using a liquid-type cooling arrangement than is possible using an air-type cooling arrangement. Therefore, internal combustion engines according to the prior art are ever more frequently being equipped with a liquid-type cooling arrangement, because the thermal loading of the engines is constantly increasing. Another reason for this is that internal combustion engines are increasingly being supercharged and—with the aim of obtaining the densest packaging possible—an ever greater number of components are being integrated into the cylinder head or cylinder block, as a result of which the thermal loading of the engines, that is to say of the internal combustion engines, is increasing. The exhaust manifold is increasingly being integrated into the cylinder head in order to be incorporated into a cooling arrangement provided in the cylinder head and in order that the manifold need not be produced from thermally highly loadable materials, which are expensive.

The formation of a liquid-type cooling arrangement necessitates that the cylinder head be equipped with at least one coolant jacket, that is to say necessitates the provision of coolant ducts which conduct the coolant through the cylinder head. The at least one coolant jacket is fed with coolant at the inlet side via a supply opening, which coolant, after flowing through the cylinder head, exits the coolant jacket at the outlet side via a discharge opening. The heat need not first be conducted to the cylinder head surface in order to be dissipated, as is the case in an air-type cooling arrangement, but rather is discharged to the coolant already in the interior of the cylinder head. Here, the coolant is delivered by means of a pump arranged in the coolant circuit, such that said coolant circulates. The heat which is discharged to the coolant is thereby discharged from the interior of the cylinder head via the discharge opening, and is extracted from the coolant again outside the cylinder head, for example by means of a heat exchanger and/or in some other way.

Like the cylinder head, the cylinder block may also be equipped with one or more coolant jackets. The cylinder head is the thermally more highly loaded component because, by contrast to the cylinder block, the head is provided with exhaust-gas-conducting lines (e.g., exhaust ports), and the combustion chamber walls which are integrated in the head are exposed to hot exhaust gas for longer than the cylinder liners provided in the cylinder block. Furthermore, the cylinder head has a lower component mass than the block.

As coolant, use is generally made of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is basically considered to be advantageous.

The internal combustion engine to which the present invention relates is liquid-cooled and has at least one liquid-cooled cylinder head and a liquid-cooled cylinder block.

To form a coolant circuit, the outlet-side discharge openings at which the coolant is discharged are at least connectable to the inlet-side supply openings which serve for the feed of coolant to the coolant jackets, for which purpose a line or multiple lines may be provided. Said lines need not be lines in the physical sense but rather may also be integrated in portions into the cylinder head, the cylinder block or some other component. An example of such a line is a recirculation line in which a heat exchanger is arranged in order to extract heat from the coolant. In this context, "at least connectable" means that the discharge openings are either permanently connected to the supply openings via a line system, or can be connected to one another in targeted fashion through the use of valves and/or shut-off elements.

It is not the aim and the purpose of a liquid-type cooling arrangement to extract the greatest possible amount of heat from the internal combustion engine under all operating conditions. In fact, what is sought is demand-dependent control of the liquid-type cooling arrangement, which aside from full load also makes allowance for the operating modes of the internal combustion engine in which it is more advantageous for less heat, or as little heat as possible, to be extracted from the internal combustion engine.

To reduce the friction losses and thus the fuel consumption of an internal combustion engine, fast heating of the engine oil, in particular after a cold start, may be expedient. Fast heating of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Known from the prior art are numerous concepts by means of which the friction losses can be reduced by means of fast heating of the engine oil. The oil may for example be actively heated by means of an external heating device. The heating device however consumes additional fuel, which counteracts a reduction in fuel consumption. In other concepts, the engine oil which is heated during operation is stored in an insulated container and utilized in the event of a re-start. The oil which is heated during operation however cannot be stored at high temperature for an unlimited length of time. In a further concept, in the warm-up phase, a coolant-operated oil cooler is utilized, contrary to its intended purpose, for heating the oil, though this in turn assumes fast heating of the coolant.

Fast heating of the engine oil in order to reduce friction losses may basically also be abetted by means of fast heating of the internal combustion engine itself, which in turn is assisted, that is to say forced, by virtue of as little heat as possible being extracted from the internal combustion engine during the warm-up phase.

In this respect, the warm-up phase of the internal combustion engine after a cold start is an example of an operating mode in which as little heat as possible, for example no heat, should be extracted from the internal combustion engine.

Control of the liquid-type cooling arrangement in which the extraction of heat after a cold start is reduced for the purpose of fast heating of the internal combustion engine may be realized through the use of a temperature-dependently self-controlling valve, often also referred to in the prior art as a thermostat valve. A thermostat valve of said type has a temperature-reactive element which is controlled by coolant, wherein a line which leads through the valve is blocked or opened up—to a greater or lesser extent—as a function of the coolant temperature at the element. In this way, it is for example possible for coolant to be recirculated from the outlet side to the inlet side of the cooling circuit via a bypass line which bypasses a heat exchanger arranged in a recirculation line.

Also known from the prior art are so-called no-flow strategies in which the coolant flow through the cylinder head and/or through the cylinder block is stopped entirely in order that as little heat as possible is extracted from the internal combustion engine.

In an internal combustion engine which has both a liquid-cooled cylinder head and also a liquid-cooled cylinder block, like the internal combustion engine which is the subject of the present invention, it would be advantageous for the coolant flow through the cylinder head and through the cylinder block to be controllable independently of one another, in particular because the two components are thermally loaded to different degrees and exhibit different warm-up behavior.

Control of the liquid-type cooling arrangement is basically sought with which it is possible not only for the circulating coolant flow rate or the coolant throughput to be reduced or stopped respectively after a cold start, but also for the thermal management of the internal combustion engine in general to be manipulated.

For comfort reasons, it may be advantageous or desirable, in particular after a cold start, for a coolant-operated vehicle interior heater to be fed, via a heating circuit line, with coolant that has been pre-warmed in the cylinder head and/or cylinder block. Here, there is a conflict of aims, specifically between, on the one hand, the pre-warming of coolant in the cylinder head or cylinder block in order to provide pre-warmed coolant to the heater, and, on the other hand, the stopping or reduction of the coolant flow through the cylinder head or cylinder block in order that as little heat as possible is extracted from the internal combustion engine during the warm-up phase.

From the prior art, cooling concepts are known which have two mutually separate and thus independent cooling circuits. Here, a so-called main coolant circuit is formed which conducts relatively large coolant flow rates through the at least one coolant jacket integrated in the cylinder block, and a so-called secondary coolant circuit which conducts relatively small coolant flow rates through the at least one coolant jacket integrated in the cylinder head. The coolant-operated vehicle interior heater is incorporated in the secondary circuit, that is to say is fed, via the heating circuit line, with coolant that has been pre-warmed in the cylinder head. The coolant flow through the cylinder block may consequently be stopped during the warm-up phase of the internal combustion engine, while at the same time the heater continues to be fed with coolant. Whereas—as is conventional—the coolant stream in the main circuit is conveyed by means of a mechanically driven water pump, an electrically operated pump is provided in the secondary circuit. Said additional pump considerably increases the costs and the space requirement of the liquid-type cooling arrangement. Furthermore, only relatively low coolant flow rates can be fed to the vehicle interior heater. If relatively high coolant flow rates are demanded, these cannot be provided.

Against this background, it is an object of the present invention to provide an internal combustion engine as per the preamble of claim 1, the cooling arrangement of which is optimized with regard to costs, space requirement and in particular with regard to comfort demands in conjunction with a coolant-operated vehicle interior heater.

It is a further sub-object of the present invention to specify a method for controlling the cooling arrangement of an internal combustion engine of said type.

The first object is achieved by means of an internal combustion engine having at least one liquid-cooled cylinder head and one liquid-cooled cylinder block, in which the at least one cylinder head is equipped with at least one integrated coolant jacket, said first coolant jacket having, at the inlet side, a first supply opening for the feed of coolant and, at the outlet side, a first discharge opening for the discharge of the coolant, the cylinder block is equipped with at least one integrated coolant jacket, said coolant jacket, which is associated with the block, having, at the inlet side, a second supply opening for the feed of coolant and, at the outlet side, a second discharge opening being provided for the discharge of the coolant, and, to form a coolant circuit, the discharge openings can be at least connectable to the supply openings, and wherein the second discharge opening is at least connectable to the second supply opening via a recirculation line in which there is arranged a heat exchanger, and the second discharge opening is at least connectable to the second supply opening via a bypass line which bypasses the heat exchanger arranged in the recirculation line, the first discharge opening is at least connectable to the first supply opening via a heating circuit line in which there is arranged a coolant-operated vehicle interior heater, upstream of the supply openings there is provided a common pump for delivering coolant to the two supply openings, wherein the pump comprises a housing and a shut-off element is provided between the pump and the second supply opening, and the heating circuit line issues into the bypass line.

The internal combustion engine according to the invention has a liquid-cooled cylinder head and a liquid-cooled cylinder block, wherein the at least one coolant jacket integrated in the cylinder head and the at least one coolant jacket integrated in the cylinder block are separated from one another.

According to the invention, the first discharge opening of the first coolant jacket integrated in the cylinder head is at least connectable to the first supply opening via the heating circuit line, such that the coolant-operated heater can, in all operating states, be fed with coolant that has been pre-warmed in the cylinder head. Thus, a minimum feed of warmed coolant to the heater is ensured.

When required, coolant that has been pre-warmed in the cylinder head can be fed to the coolant-operated heater via the heating circuit line, while the coolant flow through the at least one coolant jacket associated with the block is stopped by virtue of the shut-off element provided upstream of the second supply opening, that is to say upstream of the supply opening associated with the block, being closed. The coolant flow through the cylinder block may consequently be stopped during the warm-up phase of the internal combustion engine, in order that as little heat as possible is extracted from the internal combustion engine, while at the same time the heater continues to be fed with coolant.

Since both supply openings, that is to say both the coolant jacket associated with the head and also the coolant jacket associated with the block, are fed with coolant by means of a common pump arranged upstream of the two supply openings, it is possible, for all of the coolant to be supplied to the coolant-operated heater when the second supply opening is deactivated by means of the closed shut-off element. That is to say that, according to the invention, there is no restriction to relatively low coolant flow rates, such as is known from concepts with a secondary circuit. Furthermore, the need to provide an additional, for example electrically operated pump is omitted. The disadvantages associated with an additional pump of said type, specifically the increased costs and increased space requirement, are omitted along with the pump.

A further advantage arises through the fact that the cylinder head is thermally more highly loaded than the cylinder block, such that the head heats up more quickly after a cold start, and consequently the coolant flow through the cylinder head reaches a higher temperature more quickly than a coolant flow through the cylinder block. With regard to fast heating of the passenger compartment after a cold start, this is a noticeable advantage in terms of comfort.

By means of the internal combustion engine according to the invention, the first object on which the invention is based is achieved, that is to say an internal combustion engine is provided, the cooling arrangement of which is optimized with regard to costs, space requirement and in particular with regard to the demands for comfort in conjunction with a coolant-operated vehicle interior heater.

The coolant conducted through the cylinder block can, after exiting the second discharge opening, be recirculated to the inlet side optionally via the recirculation line or via the bypass line, wherein, if desired, heat can be extracted from the coolant in a heat exchanger arranged in the recirculation line. Said coolant stream may be controlled by means of a thermostat valve provided downstream of the second discharge opening.

The pump ensures that the coolant circulates in the coolant circuits and heat can be dissipated by means of convection. Embodiments of the internal combustion engine are advantageous in which the pump is variably controllable such that the coolant throughput can be influenced by means of the delivery pressure.

The coolant conducted through the heater or through the heating circuit line is, according to the invention, recirculated to the inlet side via the bypass line, wherein the heat exchanger arranged in the recirculation line is bypassed.

This approach corresponds to the objective of supplying coolant at as high a temperature as possible to the heater, and to the objective of forcing the warming of the coolant in order to accelerate the heating of the internal combustion engine. Extracting heat from the coolant in the heat exchanger would counteract said objectives.

Further advantageous embodiments according to the sub-claims will be described in more detail below. Here, it will in particular be made clear how the coolant streams are adjusted and conducted, or which lines of the circuits are opened up and shut off, and what effects and actions advantageously result from this.

Embodiments of the internal combustion engine are advantageous in which the first coolant jacket integrated in the cylinder head and the coolant jacket associated with the block are separated from one another. The realization of the above features is necessary in order that coolant that has been pre-warmed in the cylinder head can be fed to the coolant-operated heater via the heating circuit line and, at the same time, the coolant flow through the coolant jacket associated with the block can be stopped by virtue of the shut-off element being closed.

Embodiments of the internal combustion engine are advantageous in which a coolant-operated cooling device of an exhaust-gas recirculation system is provided in the heating circuit line upstream of the vehicle interior heater.

In this way, heat can be extracted from the hot exhaust gas for recirculation, and additional heat can be supplied to the coolant that has already been pre-warmed in the cylinder head. The heating power can be increased in this way. If appropriate, this reduces the coolant flow rate demanded by the heater.

Embodiments of the internal combustion engine are advantageous in which the second discharge opening, provided at the outlet side, for discharging the coolant is arranged in the cylinder block.

The coolant circuits of the liquid-cooled cylinder head and of the liquid-cooled cylinder block, or the associated coolant jackets, are separated from one another. No exchange of coolant takes place between the at least one cylinder head and the cylinder block.

Embodiments of the internal combustion engine may however also be advantageous in which the at least one cylinder head is equipped with at least two integrated and mutually separate coolant jackets, wherein the second coolant jacket is connected, in order to be fed with coolant, to the coolant jacket associated with the block, and the second discharge opening, provided at the outlet side, for the discharge of the coolant is arranged in the cylinder head.

The cylinder head and the cylinder block are, during the course of assembly, connected to one another at their assembly end sides, whereby the cylinders, that is to say the combustion chambers, of the internal combustion engine are formed.

In the present case, a coolant jacket integrated in the cylinder head, said coolant jacket being referred to as second coolant jacket, is fed with coolant via the block, and for this purpose the second coolant jacket is connected to the coolant jacket associated with the block. Here, the second coolant jacket is advantageously arranged adjacent to the assembly end side in the cylinder head in order to simplify the feed of coolant via the block.

Thus, the cylinder head is traversed partially by a flow of coolant that has already been pre-warmed in the cylinder block, and coolant that has been warmed in the cylinder head is not supplied via the heating circuit line to the heater and utilized for warming the passenger compartment, but rather is recirculated to the inlet side via the bypass line or recirculation line.

The second discharge opening provided at the outlet side serves in the present case for the discharge of the coolant out of the coolant jacket associated with the block and for the discharge of the coolant out of the second coolant jacket of the cylinder head.

Embodiments of the internal combustion engine are advantageous in which the shut-off element is a valve.

Whereas thermostat valves have a characteristic opening temperature, use is made in the present case of a shut-off element that can be actively adjusted for example by means of the engine controller, as a continuously adjustable valve, such that it is basically possible to implement characteristic-map-controlled actuation of said shut-off element, and thus also to realize a coolant temperature adapted to the present load state of the internal combustion engine, for example a higher coolant temperature at relatively low loads than at high loads.

Different coolant temperatures for different load states may be advantageous because the heat transfer in a component is determined not only by the coolant flow rate but rather significantly also by the temperature difference between the component and coolant. A relatively high coolant temperature in part-load operation is thus equivalent to a small temperature difference between the coolant and the cylinder block or cylinder head. The result is reduced heat transfer at low and medium loads. This increases efficiency in part-load operation.

By means of a shut-off element which is controlled by way of the engine controller, the coolant flow through the cylinder block and thus the amount of heat extracted can be adjusted, that is to say controlled, according to demand. Modern internal combustion engines generally have an engine controller, and it is therefore advantageous to utilize said controller for adjusting or controlling the shut-off element.

Embodiments of the internal combustion engine are advantageous in which the housing of the common pump accommodates the shut-off element. In this way, costs, weight and space requirement are reduced. The number of components is reduced, as a result of which the procurement costs and assembly costs for the cooling arrangement are fundamentally reduced.

Embodiments of the internal combustion engine are advantageous in which a second shut-off element is provided between the pump and the first supply opening.

By means of said second shut-off element, the coolant stream through the cylinder head and the heater can be adjusted according to demand, in particular when the first shut-off element is closed. Again, control and/or actuation by means of the engine controller is advantageous.

Here, embodiments of the internal combustion engine are likewise advantageous in which the housing of the common pump accommodates the second shut-off element. The reasons are those that have already been stated above.

Embodiments of the internal combustion engine are advantageous in which the second shut-off element is a valve. This permits a continuously variable adjustment of the coolant throughput.

The second sub-object on which the invention is based, specifically that of specifying a method for controlling the cooling arrangement of an internal combustion engine of a type described above, is achieved by means of a method wherein the shut-off element is closed in the warm-up phase of the internal combustion engine. According to the invention, to accelerate the heating of the internal combustion engine, a no-flow strategy with regard to the cylinder block is realized, that is to say implemented, in the warm-up phase. The coolant flow through the cylinder block is stopped entirely, specifically until predefined criteria that permit and/or require an opening of the shut-off element are met.

The coolant does not flow, but rather remains static in the coolant jacket of the cylinder block. The warming of the coolant and the heating of the internal combustion engine are thus accelerated. Such an approach forces the warming of the engine oil, as a result of which the friction losses of the internal combustion engine are lowered and the fuel consumption of the internal combustion engine is noticeably reduced.

That which has already been stated with regard to the internal combustion engine according to the invention also applies to the method according to the invention.

Embodiments of the method are advantageous in which, proceeding from a closed state of the shut-off element, said shut-off element is opened when a predefinable cylinder block temperature is exceeded.

Embodiments of the method are also advantageous in which, proceeding from a closed state of the shut-off element, said shut-off element is opened when a predefinable coolant temperature is exceeded.

In the case of internal combustion engines in which a second shut-off element is provided between the pump and the first supply opening, embodiments of the method are advantageous wherein the coolant flow through the first coolant jacket and the heater is controlled by means of said second shut-off element.

The adjustment of the first shut-off element and/or of the second shut-off element may be performed as a function of a determined cylinder head temperature, cylinder block temperature and/or vehicle interior temperature, or else as a function of a determined coolant temperature. In this way, it is possible for both the cylinder head and also the cylinder block to be temperature-controlled or cooled according to demand and for the vehicle interior to be heated.

Method variants are advantageous in which the temperature of the cylinder block and/or cylinder head is determined mathematically.

The mathematical determination of the temperature is carried out for example by means of simulation, for which use is made of models known from the prior art, for example dynamic heat models and kinetic models for determining the reaction heat generated during the combustion. As input signals for the simulation, use is made of operating parameters of the internal combustion engine which are already available, that is to say which have been determined for other purposes.

The simulation calculation is characterized in that no further components, in particular no sensors, need to be provided in order to determine the temperature, which is expedient with regard to costs. It is however a disadvantage that the temperatures determined in this way are merely an estimated value, which can reduce the quality of the control or regulation.

Method variants are also advantageous in which the temperature of the cylinder block and/or cylinder head is directly detected by measurement by means of a sensor.

The detection of the cylinder block and/or cylinder head temperature by measurement does not pose any difficulties. A cylinder block and/or cylinder head exhibits comparatively moderate temperatures even when the internal combustion engine has warmed up, and, furthermore, offers a multiplicity of options, that is to say different locations, for arranging a sensor without the functionality of the internal combustion engine being adversely affected.

To estimate the cylinder head temperature, it is also possible to take into consideration a different component temperature, in particular a cylinder block temperature, and vice versa, said component temperature being detected for example by measurement by means of a sensor or being determined mathematically by means of simulation calculation.

In a liquid-cooled internal combustion engine such as the present internal combustion engine, it is furthermore possible for the cylinder block temperature and/or cylinder head temperature to be determined, that is to say estimated, using the temperature of the coolant. The reverse approach is likewise conceivable.

The shut-off element is advantageously adjustable in continuously variable fashion such that the flow through the cylinder head and/or through the cylinder block can be adjusted as desired.

It is however basically also possible for the shut-off element to be of switchable design and to then be switched in stages.

In the warm-up phase of the internal combustion engine, during which the first shut-off element is closed, it is possible for the cylinder head to continue to be traversed by a flow of coolant and cooled, and for coolant to be conveyed via the cylinder head and heating circuit line to the coolant-operated heater, such that already during the warm-up phase, the heater is fed with coolant that has been pre-warmed in the cylinder head, and the passenger compartment is heated.

FIG. 1 schematically shows a first embodiment of the liquid-cooled internal combustion engine 1. To form a liquid-type cooling arrangement, the internal combustion engine 1 comprises a liquid-cooled cylinder head 2 and a liquid-cooled cylinder block 3.

The liquid-cooled cylinder head 2 has two integrated, mutually separate coolant jackets 2*a*, 2*b*, wherein the first integrated coolant jacket 2*a* has a first supply opening 4*a* at the inlet side for the feed of coolant and has a first discharge opening 5*a* at the outlet side for the discharge of the coolant. As such, the first integrated coolant jacket 2*a* (e.g., first cylinder head coolant jacket) and the second integrated coolant jacket 2*b* (e.g., second cylinder head coolant jacket) are fluidly separated such that there is no fluid interaction between their respective coolant flows. The second integrated coolant jacket 2*b* is fed with coolant via the cylinder block 3 (illustrated by arrows). For this purpose, the second coolant jacket 2*b* of the cylinder head 2 is arranged on the side facing toward the cylinder block 3 and is connected to a coolant jacket 3*a* integrated in the block 3, the latter coolant jacket having a second supply opening 4*b* at the inlet side for the feed of coolant. For the discharge of the coolant, a second discharge opening 5*b* is provided at the outlet side, said second discharge opening in the present case being arranged in the cylinder head 2. The coolant of the coolant jacket 3*a* associated with the block and the coolant of the second coolant jacket 2*b* integrated in the cylinder head 2 is discharged from said second discharge opening 5*b*. In this way coolant exits the first discharge opening 5*a* of the first coolant jacket 2*a* is different than and may be spaced away from the discharge opening 5*b* of the cylinder block coolant jacket 3*a* and the second coolant jacket 2*b*.

Upstream of the supply openings 4*a*, 4*b* there is provided a common pump 12 for delivering the coolant to the two supply openings 4*a*, 4*b*. The common pump 12 may be a single coolant pump such that it is the only coolant pump in the coolant system. For example, there is not a dedicated pump in the heating circuit line 6.

To form a coolant circuit, the outlet-side discharge openings 5*a*, 5*b* can be connected to the inlet-side supply openings 4*a*, 4*b* in the manner described below.

The second discharge opening 5*b* can be connected to the pump 12 and the supply openings 4*a*, 4*b* via a return line 7, in which a heat exchanger 7*a* is arranged, and/or via a bypass line 8 which bypasses the heat exchanger 7*a*. At that location in the circuit at which the bypass line 8 branches off from the recirculation line 7, there is arranged a thermostat valve 11 which automatically performs the apportioning of the coolant stream between the two lines 7, 8. Further, the second discharge opening 5*b* is not connected to the heating circuit line and no coolant flow from the second discharge opening 5*b* may flow to the interior heater 6*a*.

The first discharge opening 5*a* can be connected to the pump 12 and the supply openings 4*a*, 4*b* via a heating circuit line 6, wherein the heating circuit line 6, in which there is arranged a coolant-operated vehicle interior heater 6*a*, issues into the bypass line 8. In the present case, in the heating circuit line 6 upstream of the heater 6*a*, there is provided a coolant-operated cooling device 6*b* of an exhaust-gas recirculation system, by means of which coolant-operated cooling device the coolant is additionally heated before being supplied to the heater 6*a*. As discussed above, there is no pump in the heating circuit line 6 and the flow of coolant through the interior heater 6*a* is provided by the common pump 12.

Between the pump 12 and the second supply opening 4*b* there is provided a shut-off element 9, in the present case a valve 9*a*, which is closed in the warm-up phase of the internal combustion engine 1 (e.g., when engine temperature is below a threshold and/or during a cold-start condition) in order to force the heating of the internal combustion engine 1 by means of a no-flow strategy. The coolant flow through the cylinder block 3 is in this case stopped entirely.

Between the pump 12 and the first supply opening 4*a* there is provided a second shut-off element 10, in the present case likewise a valve 10*a*, by means of which the coolant stream through the cylinder head 2 and the heater 6*a* can be controlled and adjusted. The combination of the single common pump 12, the first shut-off element, and optionally the second shut-off element allows for selective control of coolant flow through each of the cylinder head and the cylinder block. By adjusting the shut-off elements and the pump speed, different percentages of a total coolant flow may be direction to the first cylinder head coolant jacket 2*a* and/or the cylinder block coolant jacket 3*a*. In some embodiments, a first portion of the coolant flow upstream of the pump 12 may be directed to the first cylinder head coolant jacket 2*a* while a second portion of the coolant flow upstream of the pump 12 may be directed to the cylinder block coolant jacket 3*a*. The positions of the valves may adjust the first and second portions. For example, completely closing the first shut-off element 9 may cause the first portion to be substantially the same as the total coolant flow upstream of the pump and the second portion to be substantially zero.

Figure 2A:
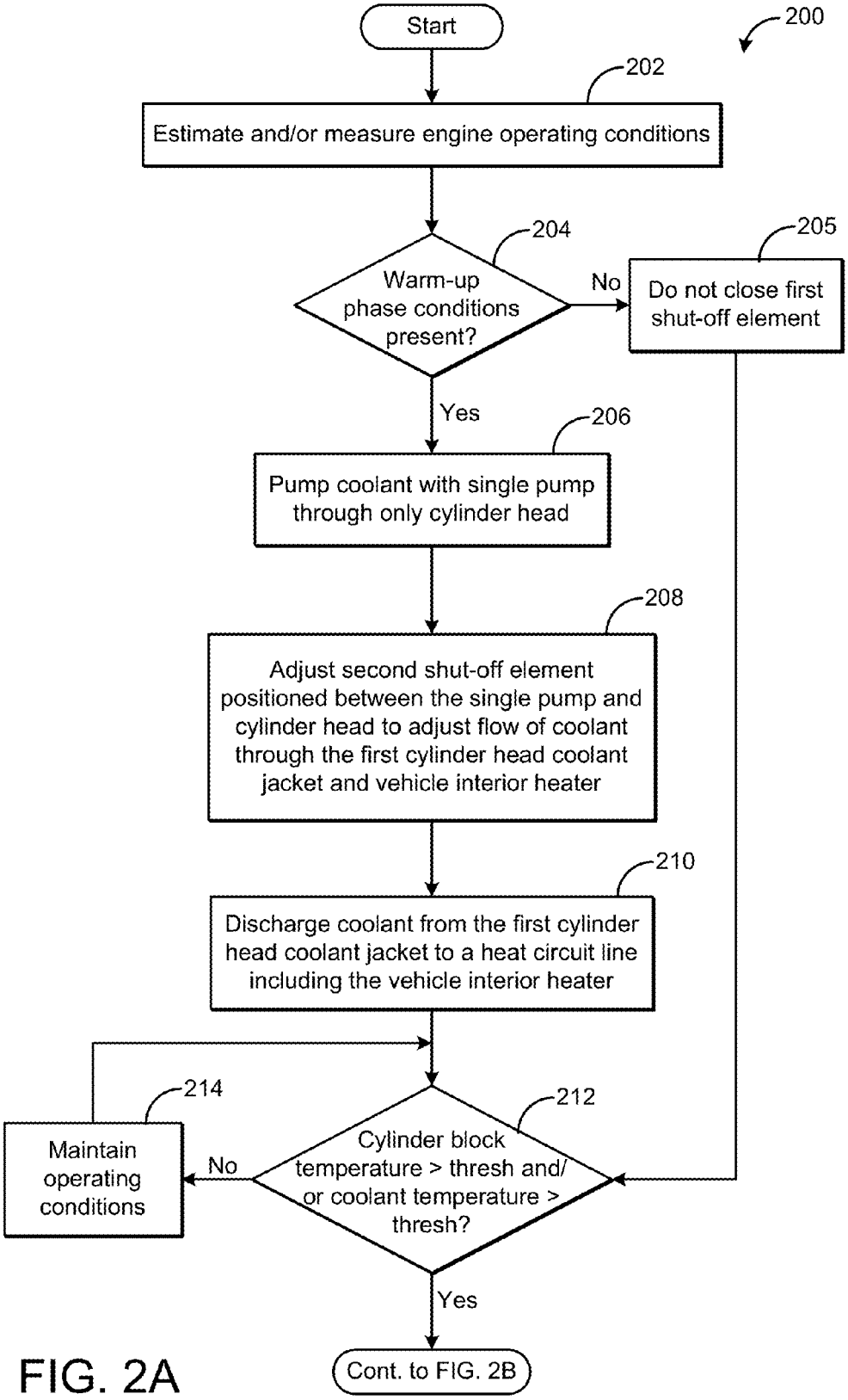
FIGS. 2A-2B are flow charts showing a method for selectively pumping coolant with a single pump through a cylinder head and/or a cylinder block.
Figure 2B:
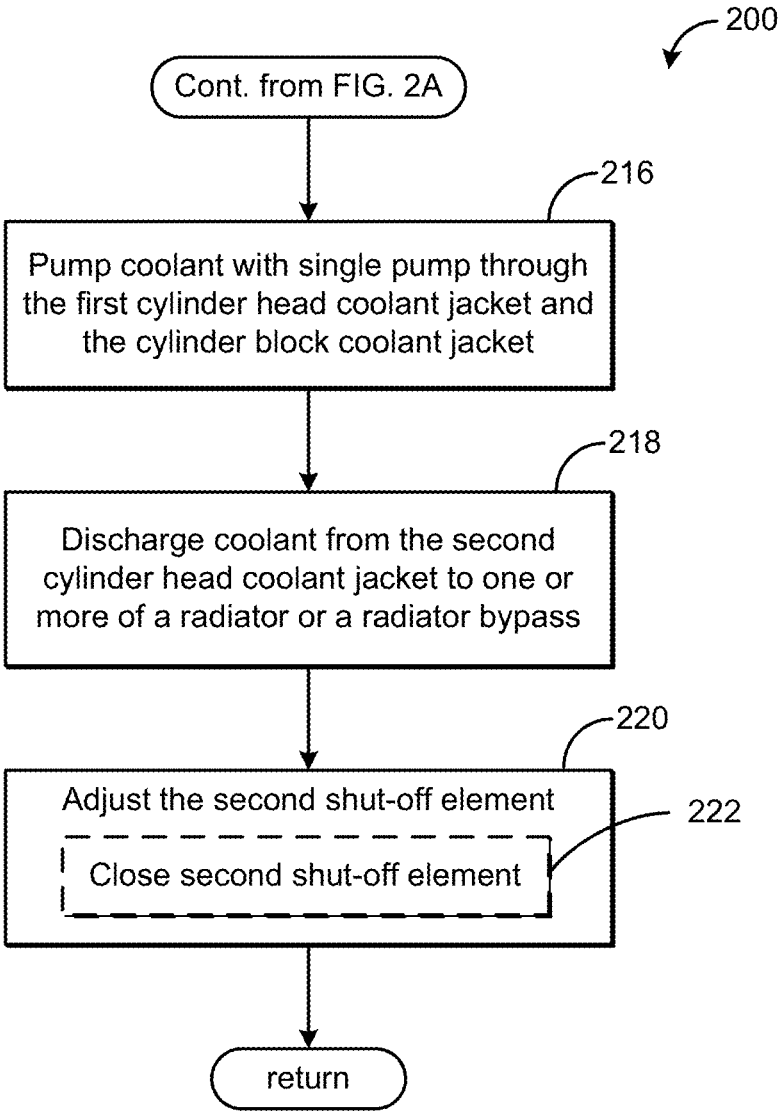

FIGS. 2A-2B show a method 200 for selectively pumping coolant with a single pump through a cylinder head and/or a cylinder block. As discussed above, the coolant flows through the cylinder block and cylinder head may be separate. Specifically, the cylinder head may include a first cylinder head coolant jacket and a second cylinder head coolant jacket, the first and second cylinder head coolant jackets fluidly separate (e.g., no coolant flow between the two jackets). The cylinder block includes one cylinder block cooling jacket. In some embodiments, the cylinder block cooling jacket is fluidly coupled to the second cylinder head coolant jacket such that coolant flow from the cylinder block coolant jacket and into the second cylinder head coolant jacket. As such, coolant flow through the cylinder block must also pass through a portion (e.g., lower portion) of the cylinder head before exiting the engine and returning back to the coolant return lines (e.g., the bypass line 8 or return line 7). Coolant flow through the first cylinder head coolant jacket exits the cylinder head and flows to a heating circuit line (e.g., heating circuit line 6 shown in FIG. 1), the heating circuit line including a vehicle interior heater which supplies heat provided by the flowing coolant to a vehicle interior. As discussed above, the heating circuit line does not include an additional pump and thus coolant flow through the first cylinder head coolant jacket and the interior heater is provided by the single (e.g., common) pump positioned upstream from both the cylinder head and cylinder block (e.g., pump 12 shown in FIG. 1). In this way, the pump 12 may be the only coolant pump in the coolant recirculation system.

As discussed above, the two different coolant flows exiting the engine are kept separate from one another until the heating circuit line meets back up with the bypass line. Additionally, flow of coolant from the pump to each of the cylinder head and cylinder block may be selectively controlled via a first shut-off element positioned between the single pump and the cylinder block and a second shut-off element positioned between the single pump and the cylinder head. In some embodiments, one or more of the shut-off elements may be integrated into the housing 12*a* of the single pump. An engine controller may adjust operation of the single pump (e.g., pump speed) and adjust a position of each of the first and second shut-off elements. For example, the shut-off elements may be valves adjustable into a plurality of positions between fully opened and fully closed. The controller may adjust the valves into these positions based on engine operation conditions such as engine load and engine temperatures. In other embodiments, the controller may just open and close the valve. In yet other embodiments, the controller may adjust the valves based on a desired flow rate or percentage of coolant flow through each of the cylinder head (e.g., first cylinder head coolant jacket and vehicle interior heater) and cylinder block (e.g., cylinder block coolant jacket and second cylinder head coolant jacket). Instructions for carrying out the method 200, described below, may be stored on a memory of the controller such that the controller may execute the method.

Method 200 begins at 202 by estimating and/or measuring engine operating conditions. Engine operating conditions may include engine speed and load, engine temperature, engine coolant temperature, cylinder block temperature, cylinder head temperature, vehicle cabin (e.g., interior) temperature, valve or shut-off element positions, engine key-on events, etc. At 202, the method may include estimating or calculating engine temperatures based on additional engine temperatures and/or combustion parameters. For example, the cylinder block temperature may be based on a measured coolant temperature and combustion parameters.

At 204, the method includes determining if engine warm-up phase conditions are present. Engine warm-up phase conditions may include a cold-start condition. In another example, engine warm-up phase conditions may include an engine temperature (e.g., cylinder block or cylinder head temperature) below a threshold temperature. If warm-up phase conditions are not present at 204 the method continues on to 205 to not close the first shut-off method. The method then continues on to 212 to assess engine and coolant temperatures to determine desired coolant flow percentages through the cylinder head and cylinder block, as described further below.

If engine warm-up phase conditions are present at 204, the method continues on to 206 to pump coolant with a single pump through only a cylinder head of an engine. Specifically, the method at 206 includes pumping coolant with the single pump (e.g., pump 12 shown in FIG. 1) through only a first cylinder head cooling jacket. The method at 206 may include closing a first shut-off element positioned between the single pump and a cylinder block. As a result, coolant flow may be blocked to the cylinder block and the cylinder block coolant jacket. Thus, the method at 206 includes pumping coolant only through the first cylinder head cooling jacket and not through the cylinder block coolant jacket or the second cylinder head jacket.

The method at 208 includes adjusting a second shut-off element positioned between the single pump and a cylinder head to adjust a flow of coolant through the first cylinder head cooling jacket and the vehicle interior heater. For example, the method at 208 may include adjusting a position (or degree of opening) of the second shut-off element to achieve a target flow rate of coolant through the cylinder head and interior heater. The target flow rate may be based on one or more of engine load, coolant temperature, and/or cylinder head temperature.

The method continues on to 210 to discharge coolant from the first cylinder head coolant jacket to a heating circuit line including a vehicle interior heater (e.g., interior heater 6*a* shown in FIG. 1). Specifically, the method at 210 may include discharging coolant from the first cylinder head coolant jacket via a first discharge opening in the cylinder head (e.g., first discharge opening 5*a* shown in FIG. 1) and then flowing coolant through the interior heater and then back to a bypass coolant line before flowing back to the pump. In some embodiments, the method at 208 may also include flowing coolant to a cooling device, such as an EGR cooling device, upstream of the interior heater in the heating circuit line.

At 212, the method includes determining if the cylinder block temperature is greater than a threshold cylinder block temperature and/or if the coolant temperature is greater than a threshold coolant temperature. The threshold cylinder block temperature and/or the threshold coolant temperature may be based on temperatures indicating that additional engine cooling is required. In some examples, these thresholds may be based on engine load conditions and may change with changing engine load. For example, these thresholds may be higher at lower engine loads. However, as engine load increases, additional engine cooling via the cylinder block may be required. If neither of the conditions at 212 are met, the method continues on to 214 to maintain engine operation. Maintaining engine operation may include maintaining a current pump seed, first shut-off element position, and second shut-off element position. The method may then return and/or circle back to 212 to re-check the engine and coolant temperatures. Alternatively at 212, if one or more of the cylinder block temperature is greater than the threshold cylinder block temperature or if the coolant temperature is greater than the threshold coolant temperature, the method continues on to 216 to pump coolant with the single pump through the first cylinder head coolant jacket and the cylinder block coolant jacket. As such, the method at 216 may include opening the first shut-off element (between the pump and the cylinder block) to allow flow from the pump and into the cylinder block coolant jack. In some embodiments, the cylinder head includes a second cylinder head coolant jacket fluidly coupled to the cylinder block coolant jacket. As such, the method at 216 may include pumping coolant through the cylinder block coolant jacket, from the cylinder block coolant jacket to the second cylinder head coolant jacket, and through the second cylinder head coolant jacket. Coolant may simultaneously but separately flow through the first cylinder head coolant jacket and to the interior heater.

The method at 218 includes discharging coolant from the second cylinder head cooling jacket to one or more of a radiator or a radiator bypass. Specifically, coolant may exit the cylinder block coolant jacket and the second cylinder head coolant jacket through a second discharge opening (e.g., second discharge opening 5*b* shown in FIG. 1). The coolant may then flow to a thermostat valve, and based on the coolant temperature, be selectively directed to the bypass line bypassing the radiator and/or the radiator.

In some embodiments, the method may include adjusting the second shut-off element positioned between the single pump and the cylinder head at 220. As a result, the flow rate or percentage of coolant flow through the first cylinder head cooling jacket and the vehicle interior heater may be adjusted. In one example, adjusting the second shut-off element may include fully closing the second shut-off element such that coolant is pumped with the single pump through only the cylinder block coolant jacket and the second cylinder head coolant jacket. Closing the second shut-off element may block (e.g., stop) coolant from flowing through the first cylinder head coolant jacket and through the interior vehicle heater. For example, the controller may close the second shut-off element if the vehicle interior temperature reaches an upper threshold such that heating of the interior is not required.

In this way, a method may comprise selectively pumping coolant with a single pump to each of a first cylinder head coolant jacket and a cylinder block coolant jacket based on engine temperatures, discharging coolant from the first cylinder head coolant jacket to a heating circuit line including a vehicle interior heater, and discharging coolant from the cylinder block cooling jacket and back to the single pump. Discharging coolant from the cylinder block coolant jacket includes selectively directing coolant to each of a radiator and a radiator bypass.

The method may further comprise flowing coolant from the cylinder block coolant jacket directly to a second cylinder head coolant jacket, the first cylinder head coolant jacket fluidly separate from the second cylinder head coolant jacket and fluidly separate from the cylinder block coolant jacket. In one example, selectively pumping coolant with the single pump includes closing a first shut-off element positioned between the single pump and a cylinder block to flow coolant only through the first cylinder head coolant jacket responsive to one or more of a cold-start condition or an engine temperature below a first threshold. In another example, selectively pumping coolant with the single pump includes opening the first shut-off element to flow coolant through the cylinder block coolant jacket responsive to one or more of a cylinder block temperature greater than a second threshold or a coolant temperature greater than a third threshold. As such, a technical effect is achieved by balancing quickly increasing an engine temperature during cold-start conditions and heating a vehicle interior while also providing adequate engine cooling as engine temperatures increase.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I -4, I -6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

selectively pumping coolant with a single pump to each of a first cylinder head coolant jacket and a cylinder block coolant jacket based on engine temperatures;

discharging coolant from the first cylinder head coolant jacket to a heating circuit line including a vehicle interior heater, then issuing coolant from the heating circuit line to a radiator bypass, where the first cylinder head coolant jacket is only within a cylinder head of the engine;

discharging coolant from the cylinder block coolant jacket directly to a second cylinder head coolant jacket, then from the second cylinder head coolant jacket back to the single pump via at least one of the radiator bypass and a recirculation line, wherein the first cylinder head coolant jacket is fluidly separate from the second cylinder head coolant jacket and fluidly separate from the cylinder block coolant jacket within a cylinder block and the cylinder head of the engine; and wherein the coolant discharged from the first cylinder head coolant jacket and the coolant discharged from the cylinder block coolant jacket are kept separate until the heating circuit line and the radiator bypass meet, where the heating circuit line and the radiator bypass meet at a location where the coolant from the heating circuit line issues into the radiator bypass.

2. The method of claim 1, wherein selectively pumping coolant with the single pump includes closing a first shut-off element positioned between the single pump and the cylinder block to flow coolant only through the first cylinder head coolant jacket responsive to one or more of a cold-start condition or an engine temperature below a first threshold.

3. The method of claim 2, wherein selectively pumping coolant with the single pump includes pumping coolant only with the single pump and opening the first shut-off element to flow coolant through the cylinder block coolant jacket responsive to one or more of a cylinder block temperature greater than a second threshold or a coolant temperature greater than a third threshold.

4. An engine method, comprising:

pumping coolant with a single pump through only a first cylinder head coolant jacket during an engine warm-up phase, where the first cylinder head coolant jacket is only within a cylinder head of the engine;

pumping coolant with the single pump through the first cylinder head coolant jacket, a cylinder block coolant jacket, and a second cylinder head coolant jacket when a cylinder block temperature is greater than a first threshold, the first cylinder head coolant jacket fluidly separate from the second cylinder head coolant jacket and the cylinder block coolant jacket, and the second cylinder head coolant jacket fluidly coupled to the cylinder block coolant jacket within a cylinder block and the cylinder head of the engine;

discharging coolant from the first cylinder head coolant jacket to a heating circuit line including a vehicle interior heater and then to a radiator bypass; and discharging coolant from the second cylinder head coolant jacket to one or more of a radiator or a radiator bypass;

wherein the coolant discharged from the first cylinder head coolant jacket and the coolant discharged from the second cylinder head coolant jacket are kept separate until the heating circuit line and the radiator bypass meet, where the heating circuit line and the radiator bypass meet at a location where coolant from the heating circuit line issues into the radiator bypass.

5. The method of claim 4, wherein pumping coolant with the single pump through only the first cylinder head coolant jacket includes closing a shut-off element positioned between the single pump and the cylinder block and wherein the engine warm-up phase includes an engine temperature below a second threshold.

6. The method of claim 5, wherein pumping coolant with the single pump through the first cylinder head coolant jacket, the cylinder block coolant jacket, and the second cylinder head coolant jacket includes opening the shut-off element responsive to one or more of the cylinder block temperature greater than the first threshold or a coolant temperature greater than a third threshold.

7. The method of claim 4, further comprising adjusting a second shut-off element positioned between the single pump and the cylinder head to adjust a flow of coolant through the first cylinder head coolant jacket and the vehicle interior heater.

8. The method of claim 7, further comprising pumping coolant with the single pump through only the cylinder block coolant jacket and the second cylinder head coolant jacket, the pumping coolant through only the cylinder block coolant jacket and the second cylinder head coolant jacket including closing the second shut-off element.

9. The method of claim 8, further comprising adjusting a shut-off element positioned between the single pump and the cylinder block and the second shut-off element based on one or more of coolant temperature, cylinder head temperature, cylinder block temperature, vehicle interior temperature, or engine load.

10. An internal combustion engine, comprising:

at least one liquid-cooled cylinder head and one liquid-cooled cylinder block, wherein the at least one cylinder head is equipped with at least two integrated and mutually separate coolant jackets, including:

a first cylinder head coolant jacket located only in the cylinder head and having, at an inlet side, a first supply opening for the feed of coolant and, at an outlet side, a first discharge opening for the discharge of the coolant; and a second cylinder head coolant jacket connected, in order to be supplied with coolant, to a cylinder block coolant jacket;

the cylinder block is equipped with at least one integrated cylinder block coolant jacket, said cylinder block coolant jacket, which is associated with the cylinder block, having, at an inlet side, a second supply opening for the feed of coolant and, at an outlet side, a second discharge opening being provided for the discharge of the coolant to supply the second cylinder head coolant jacket, and to form a coolant circuit, the discharge openings are at least connectable to the supply openings, wherein the second discharge opening is connectable to the second supply opening via the second cylinder head coolant jacket and a recirculation line in which there is arranged a heat exchanger, the second discharge opening is connectable to the second supply opening via the second cylinder head coolant jacket and a bypass line which bypasses the heat exchanger arranged in the recirculation line, the first discharge opening is connectable to the first supply opening via a heating circuit line in which there is arranged a coolant-operated vehicle interior heater, upstream of the supply openings there is provided a common pump for delivering coolant to the two supply openings, wherein the pump comprises a housing and a shut-off element is provided between the pump and the second supply opening, and the heating circuit line issues into the bypass line, wherein coolant discharged from the first discharge opening to the heating circuit line and coolant discharged from the second discharge opening to the bypass line are kept separate until the heating circuit line and the bypass line meet, where the heating circuit line and the bypass line meet at a location where coolant from the heating circuit line issues into the bypass line.

11. The internal combustion engine of claim 10, wherein the first cylinder head coolant jacket integrated in the cylinder head and the cylinder block coolant jacket associated with the cylinder block are separated from one another.

12. The internal combustion engine of claim 10, wherein a coolant-operated cooling device of an exhaust-gas recirculation system is provided in the heating circuit line upstream of the vehicle interior heater.

13. The internal combustion engine of claim 10, wherein the second discharge opening, provided at the outlet side, for discharging the coolant is arranged in the cylinder block.

14. The internal combustion engine of claim 10, wherein the second discharge opening, provided at the outlet side, for discharging the coolant is arranged in the cylinder head.

15. The internal combustion engine of claim 10, wherein the shut-off element is a valve and wherein the housing of the common pump accommodates the shut-off element.

16. The internal combustion engine of claim 10, wherein a second shut-off element is provided between the common pump and the first supply opening.

17. The internal combustion engine of claim 16, wherein the housing of the common pump accommodates the second shut-off element and wherein the second shut-off element is a valve.

* * * * *